US009023158B2

(12) United States Patent
Yoshida et al.

(10) Patent No.: US 9,023,158 B2
(45) Date of Patent: May 5, 2015

(54) STEEL MATERIAL SUPERIOR IN HIGH TEMPERATURE CHARACTERISTICS AND TOUGHNESS AND METHOD OF PRODUCTION OF SAME

(75) Inventors: Suguru Yoshida, Tokyo (JP); Hiroshi Kita, Tokyo (JP); Teruhisa Okumura, Tokyo (JP); Hirokazu Sugiyama, Tokyo (JP); Teruyuki Wakatsuki, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 1027 days.

(21) Appl. No.: 12/450,651

(22) PCT Filed: Apr. 4, 2008

(86) PCT No.: PCT/JP2008/057120

§ 371 (c)(1),
(2), (4) Date: Oct. 2, 2009

(87) PCT Pub. No.: WO2008/126910

PCT Pub. Date: Oct. 23, 2008

(65) Prior Publication Data

US 2010/0078097 A1 Apr. 1, 2010

(30) Foreign Application Priority Data

Apr. 6, 2007 (JP) ..... 2007-100628
Nov. 29, 2007 (JP) ..... 2007-309172

(51) Int. Cl.
*C22C 38/04* (2006.01)
*C22C 38/02* (2006.01)
(Continued)

(52) U.S. Cl.
CPC . *C22C 38/02* (2013.01); *C21D 7/13* (2013.01); *C21D 8/0226* (2013.01); *C22C 38/04* (2013.01); *C22C 38/06* (2013.01); *C22C 38/58* (2013.01)

(58) Field of Classification Search
CPC ..... C22C 38/04
USPC ..... 148/320, 331–336; 420/83–84, 89–93, 420/104–112, 119–121, 123–124, 126–128
See application file for complete search history.

(56) References Cited

U.S. PATENT DOCUMENTS 6,299,710 B1 * 10/2001 Itakura et al. ..... 148/654
8,097,096 B2 * 1/2012 Yoshida et al. ..... 148/320

FOREIGN PATENT DOCUMENTS

JP 4-350127 12/1992
JP 4-362156 12/1992

(Continued)

OTHER PUBLICATIONS

Kuzmanović et al. "Steel Design for Structural Engineers." 1977. Prentice-Hall, Inc. pp. 22-27.*

(Continued)

*Primary Examiner* — Brian Walck
(74) *Attorney, Agent, or Firm* — Kenyon & Kenyon LLP

(57) ABSTRACT

A steel material superior in high temperature characteristics and toughness is provided, that is, a steel material containing, by mass %, C: 0.005% to 0.03%, Si: 0.05% to 0.40%, Mn: 0.40% to 1.70%, Nb: 0.02% to 0.25%, Ti: 0.005% to 0.025%, N: 0.0008% to 0.0045%, B: 0.0003% to 0.0030%, restricting P: 0.030% or less, S: 0.020% or less, Al: 0.03% or less, and having a balance of Fe and unavoidable impurities, where the contents of C and Nb satisfy $$C-Nb/7.74 \leq 0.02$$

and Ti-based oxides of a grain size of 0.05 to 10 μm are present in a density of 30 to 300/mm$^2$.

8 Claims, 5 Drawing Sheets

(51) Int. Cl.

| | |
|---|---|
| ***C21D 7/13*** | (2006.01) |
| ***C21D 8/02*** | (2006.01) |
| ***C22C 38/06*** | (2006.01) |
| ***C22C 38/58*** | (2006.01) |

(56) References Cited

FOREIGN PATENT DOCUMENTS

| | | | | |
|---|---|---|---|---|
| JP | 04-362156 | | 12/1992 | |
| JP | 11-302770 | | 11/1999 | |
| JP | 2000-248335 | | 9/2000 | |
| JP | 2002115022 | A * | 4/2002 | ..... C22C 38/00 |
| JP | 2002-212632 | | 7/2002 | |
| JP | 2004-339549 | | 12/2004 | |
| JP | 2004-360361 | | 12/2004 | |
| JP | 2006002198 | A * | 1/2006 | |
| KR | 10-2004-0089746 | | 9/2006 | |
| WO | WO 03/087414 | | 10/2003 | |

OTHER PUBLICATIONS

English language machine translation of JP 2002115022 A to Watabe. Generated Mar. 27, 2009.*

"Principles of Liquid Metal Processing." ASM Handbook vol. 15: Casting. Sep. 1988. pp. 78-79.*

International Search Report dated Jul. 1, 2008 issued in corresponding PCT Application No. PCT/JP2008/057120.

Office Action in Korean Patent Application No. 10-2009-7020737 dated Jun. 14, 2011, 4 pages.

* cited by examiner

STEEL MATERIAL SUPERIOR IN HIGH TEMPERATURE CHARACTERISTICS AND TOUGHNESS AND METHOD OF PRODUCTION OF SAME

This application is a national stage application of International Application No. PCT/JP2008/057120, filed 4 Apr. 2008, which claims priority to Japanese Application Nos. 2007-100628, filed 6 Apr. 2007; and 2007-309172, filed 29 Nov. 2007, each of which is incorporated by reference in its entirety.

TECHNICAL FIELD

The present invention relates to a fire resistant steel material and a method of production of the same.

BACKGROUND ART

Due to the increasingly number of high rise buildings, the greater sophistication of building designs, etc., fire resistant design codes were revised as a major project of the Japan Ministry of Construction. In March 1987, a new fire resistant design code was enacted. Under this, the old restriction relating to fire resistant coverings requiring the temperature of the steel material at the time of a fire be kept to 350° C. or less was lifted and it was allowed to select a suitable fire resistant covering method in accordance with the high temperature strength of the steel material and the actual load of the building. That is, when possible to secure the design high temperature strength at 600° C., it became possible to eliminate the fire resistant covering.

The 600° C. high temperature strength of a steel material, like the ordinary temperature reinforcing mechanism, is improved by (1) increased fineness of ferrite crystal grain size, (2) solution strengthening by alloy elements, (3) dispersion strengthening by hard phases, and (4) precipitation strengthening by fine precipitates, mainly precipitation strengthening.

Conventional fire resistant steel mainly raises the high temperature softening resistance by precipitation strengthening by carbides of Mo. However, Mo is an expensive element. When the amount added is large, the economy is detracted from, so suppression of the amount of addition is necessary. No addition of Mo is preferable. Furthermore, if the amount of addition of Mo becomes excessive, reheat embrittlement due to precipitation of carbides is feared.

To deal with this problem, fire resistant steel complexly adding Nb, B, and Ti and improving the high temperature strength has been proposed (for example, see Japanese Patent Publication (A) No. 4-350127, Japanese Patent Publication (A) No. 11-302770, and Japanese Patent Publication (A) No. 2000-248335).

However, these do not consider the suppression of the coarsening of the precipitates at the weld heat affected zone (HAZ) at the time of welding. A drop in HAZ toughness is feared.

To deal with such a drop in HAZ toughness, a steel material with the effect of suppression of grain growth by Ti-based oxides and using the intra-granular ferrite nucleation with this as nuclei for growth so as to prevent the coarsening of the crystal grain size at the HAZ has been proposed (for example, see Japanese Patent Publication (A) No. 4-362156).

Furthermore, a method of production of H-section steel utilizing intra-granular ferrite nucleation by Ti-based oxides to make the microstructure even has also been proposed (for example, see Japanese Patent Publication (A) No. 2002-212632).

However, with thick steel plate, shaped steel, and the like, a large heat input is used for welding. The vicinity of the weld zone is heated to a high temperature, so in particular when a HAZ which has been heated once to a high temperature by welding is again heated, the problem arises of embrittlement due to precipitation of carbides and nitrides. The steel materials proposed in these prior patent literature did not consider such HAZ high temperature embrittlement (below, called "reheat embrittlement").

Further, for extremely thick H-section steel used mainly as columns for high rise buildings as well, along with the increase in thickness and size, the production process becomes lower in reduction rate and lower in cooling speeds, so compared with thin-gauge steel material, sufficient working heat treatment becomes more difficult. Therefore, in the prior art, to secure strength, alloy elements had to be added in large amounts. In that case, a drop in toughness, drop in weldability, and other concomitant problems arose.

SUMMARY OF INVENTION

The present invention provides a steel material superior in reheat embrittlement resistance characteristics and other high temperature characteristics at the weld heat affected zone and toughness of the base material and HAZ able to be used as a fire resistant steel material or extremely thick H-section steel and a method of production of the same.

The present invention adds fine amounts of B and Nb to raise the quenchability and secure ordinary temperature strength and utilizes the drag effect of the solid solution Nb (phenomenon where the solid solution Nb concentrates at dislocations and other lattice defects, becomes resistance to movement of defects and dislocations, and improves the strength) to raise the high temperature strength, furthermore, utilizes the fine oxides of Ti for pinning of the crystal grain boundaries and formation of intra-granular ferrite nucleation to suppress coarsening of the HAZ, prevent the rise of concentration of B segregating at the grain boundaries to reduce fluctuation of mechanical characteristics due to thickness, and improve reheat embrittlement resistance and other high temperature characteristics, and further secures toughness of the base material and the HAZ by adjusting the concentration of solute oxygen in the molten steel at the time of addition of Ti to disperse fine oxides of Ti in the steel to provide a steel material and a method of production of the same.

This gist of the present invention is as follows.

(1) A steel material superior in high temperature characteristics and toughness characterized by containing by mass %, C: 0.005% to 0.03%, Si: 0.05% to 0.40%, Mn: 0.40% to 1.70%, Nb: 0.02% to 0.25%, Ti: 0.005% to 0.025%, N: 0.0008% to 0.0045%, B: 0.0003% to 0.0030%, restricting P: 0.030% or less, S: 0.020% or less, Al: 0.03% or less, and having a balance of Fe and unavoidable impurities, where the contents of C and Nb satisfy $$C—Nb/7.74 \leq 0.02$$

and Ti-based oxides of a grain size of 0.05 to 10 μm are present in a density of 30 to 300/mm$^2$.

(2) A steel material superior in high temperature characteristics and toughness as set forth in (1) characterized by containing, by mass %, one or both of V: 0.10% or less and Mo: 0.10% or less.

(3) A steel material superior in high temperature characteristics and toughness as set forth in (1) or (2) characterized by containing, by mass %, one or more of Zr: 0.03% or less and Hf: 0.01% or less.

(4) A steel material superior in high temperature characteristics and toughness as set forth in any one of the above (1) to (3) characterized by containing, by mass %, one or more of Cr: 1.5% or less, Cu: 1.0% or less, and Ni: 0.7% or less.

(5) A steel material superior in high temperature characteristics and toughness as set forth in any one of the above (1) to (4) characterized by containing, by mass %, one or more of Mg: 0.005% or less, REM: 0.01% or less, and Ca: 0.005% or less.

(6) A steel material superior in high temperature characteristics and toughness as set forth in any one of the above (1) to (5) characterized in that a mass concentration product of Nb and C is 0.0015 or more.

(7) A steel material superior in high temperature characteristics and toughness as set forth in any one of the above (1) to (6) characterized in that the steel material is a fire resistant steel material.

(8) A steel material superior in high temperature characteristics and toughness as set forth in any one of the above (1) to (6) characterized in that the steel material is extremely thick H-section steel with a flange thickness of 40 mm or more.

(9) A method of production of a steel material superior in high temperature characteristics and toughness characterized by adjusting steel comprised of ingredients as set forth in any of the above (1) to (6) to a solute oxygen of 0.003 to 0.015 mass %, then adding Ti, melting, and casting to obtain a steel slab, and heating this to 1100 to 1350° C. and hot rolling.

(10) A method of production of a steel material superior in high temperature characteristics and toughness as set forth in (9), characterized by hot rolling by a cumulative reduction rate at 1000° C. and below of 30% or more.

(11) A method of production of a steel material superior in high temperature characteristics and toughness as set forth in (9) or (10) characterized by hot rolling, then cooling from 800° C. to 500° C. temperature range by a 0.1 to 10° C./s average cooling speed.

According to the present invention, steel material having a sufficient ordinary temperature strength and high temperature strength and superior in base material and HAZ toughness and reheat embrittlement resistance characteristics, in particular, fire resistant H-section steel and extremely thick H-section steel, can be produced without cold working and heat treatment for thermal refining or extremely thick H-section steel having a thickness of a large size, for example, of up to a flange thickness of 140 mm or more can be produced as hot rolled while securing strength and toughness.

Among steel materials, H-section steel produced by hot rolling is broken down by shape into flange, web, and fillet part locations. The rolling temperature history and cooling speed differ according to these shapes, so even with the same ingredients, the mechanical characteristics will sometimes greatly change depending on the part location.

Steel having the composition of ingredients of the present invention has relatively small rolling finishing temperature dependency and cooling speed dependency on the strength and toughness, the variation in quality in cross-sectional part locations in H-section steel can be lightened, and, further, the changes in quality due to thickness can be made smaller, so, in particular, strength and toughness at thicknesses of large sizes such as with extremely thick H-section steel can be secured and variations in quality in the cross-sections of H-section steel can be reduced.

EMBODIMENTS OF INVENTION

Figure 1:
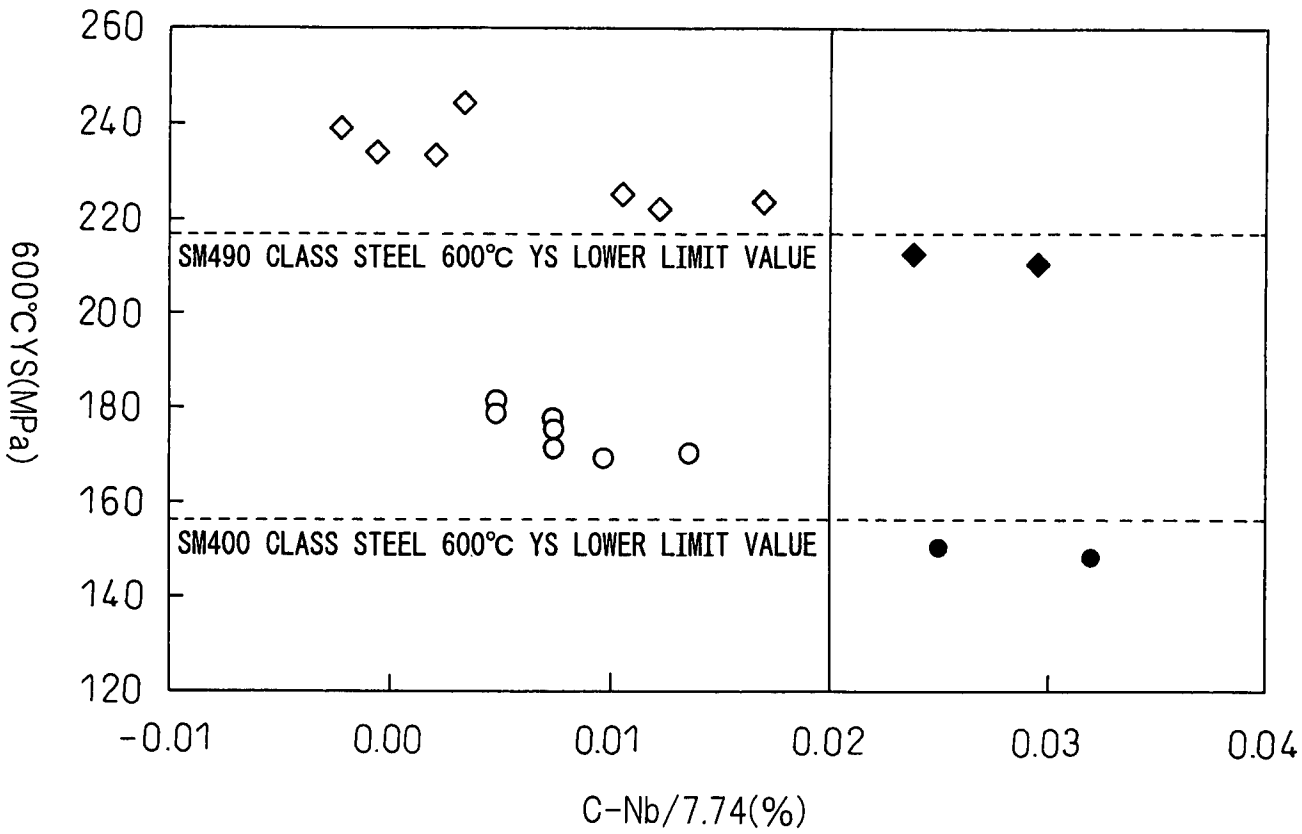
FIG. 1 is a view showing the effects of C and Nb on the high temperature strength of a steel material.

The inventors studied using the addition of B and Nb to improve the quenchability and forming one or both of massive ferrite or bainite so as to raise the high temperature strength and ordinary temperature strength and toughness and obtain a steel material superior in reheat embrittlement resistance characteristics, in particular H-section steel.

As a result, they discovered that by securing solid solution Nb, it is possible to slow the speed of movement of dislocations at a high temperature by the drag effect and possible to exhibit resistance to softening at a high temperature and secure strength as a fire resistant steel material.

Furthermore, they studied the lowering of C, lowering of N, and utilization of oxides of Ti so as to bring out the effects of B and Nb to the maximum. As a result, they obtained the following discoveries.

Lowering the C and lowering the N are effective for suppressing the formation of polygonal ferrite and securing solid solution Nb and solid solution B. Nb and B carbides, that is, NbC and $Fe_{23}CB_6$, and nitrides, that is, NbN and BN, form the nuclei for formation of ferrite.

Further, due to the precipitation of carbides and nitrides, the solid solution Nb and solid solution B are reduced. In particular, if small amounts of carbides and nitrides of Nb and B finely precipitate, this contributes to the improvement of strength by precipitation strengthening, but at the time of welding, NbC and BN will precipitate at the crystal grain boundaries of the austenite at the time of welding (below, also called "γ grain boundaries") to cause reheat embrittlement. Therefore, to secure reheat embrittlement resistance characteristics, it is extremely important to define the upper limits of the amount of addition of C and the amount of addition of N.

Furthermore, if dispersing fine oxides of Ti into the steel, the crystal grains can be pinned and the coarsening of the grain size of the HAZ can be prevented even at the peak temperature of the weld heat cycle. Further, fine oxides of Ti act as nuclei for the formation of intra-granular ferrite nucleation in the HAZ. Due to the ferrite in the grains produced, the coarsening of the grain size of the HAZ is further suppressed. Prevention of this coarsening of the grain size of the HAZ is extremely effective for suppression of reheat embrittlement as well. This is because if the grain size of the HAZ coarsens, the grain boundary area will decrease, the grain boundary concentration of B and Nb segregating at the grain boundaries will rise, precipitation of carbides, nitrides, etc. at the grain boundary will be promoted, and grain boundary embrittlement will be assisted.

To make fine oxides of Ti disperse in the steel, it is necessary to use preheating deoxidation to adjust the concentration of solute oxygen to 0.003 to 0.015% in range of concentration, then add Ti. Further, if excessively adding the powerful deoxidizing element Al, fine oxides of Ti will not be formed, so the content of Al has to be suppressed to less than 0.03%.

Further, steel with a content of carbon of over 0.03% is formed with island-shaped martensite, remarkably drops in toughness, and has parts not satisfying the standards, so the content of carbon has to be made 0.03% or less.

Based on the above findings, the inventors further studied in detail the relationship of C and Nb and the high temperature strength of a steel material, the amount of solute oxygen before the addition of Ti, the relationship of the grain size and density of Ti-based oxides and the HAZ toughness, and the effect on the reheat embrittlement resistance characteristics.

The inventors produced steel containing, by mass %, 0.03% or less, Si: 0.05% to 0.4%, Mn: 0.4% to 1.7%, Nb: 0.02% to 0.25%, and N: 0.0008% to 0.0045%, B: 0.0003% to 0.0030%, restricting the impurities P and S to respectively 0.03% or less and 0.02% or less and the deoxidizing element Al to 0.03% OR LESS, and having a balance of Fe and unavoidable impurities by changing the amount of solute oxygen when adding Ti, cast this to obtain a steel slab, heated it to 1100 to 1350° C., and hot rolled this to a cumulative reduction rate at 1000° C. and below of 30% or more to produce steel plate of a thickness of 10 to 40 mm.

From the steel plate, they obtained tensile test pieces based on JIS Z 2201 and ran ordinary temperature tensile tests based on JIS Z 2241 and 600° C. tensile tests based on JIS G 0567. Further, they obtained small pieces from the steel plate, heated them by a temperature elevation rate of 10° C./s to 1400° C. and held them there for 1 second, then cooled by a time required for cooling from 800° C. to 500° C. of 10 seconds for heat treatment simulating the heat history of HAZ (referred to as "HAZ reproduction heat treatment"), then worked them into test pieces and ran Charpy impact tests based on JIS Z 2242. Further, they measured the grain size and density of the Ti-based oxides using a scan type electron microscope.

FIG. 1 shows the relationship between the contents of C and Nb and the high temperature strength, specifically, the 0.2% proof stress (600° C. YS) at 600° C., with respect to C—Nb/7.74. In the figure, ○ and ● indicate the 600° C. YS of steel materials of an ordinary temperature tensile strength of the 400 MPa class, while ◇ and ◆ show the 600° C. YS of steel materials of the 490 MPa class.

From FIG. 1, it is learned that if C−Nb/7.74 becomes 0.02 or less, the ordinary temperature tensile strength becomes the 400 MPa class, the 600° C. 0.2% proof stress of 490 MPa class steel material exceeds the target value, and a good high temperature strength is obtained.

Figure 2:
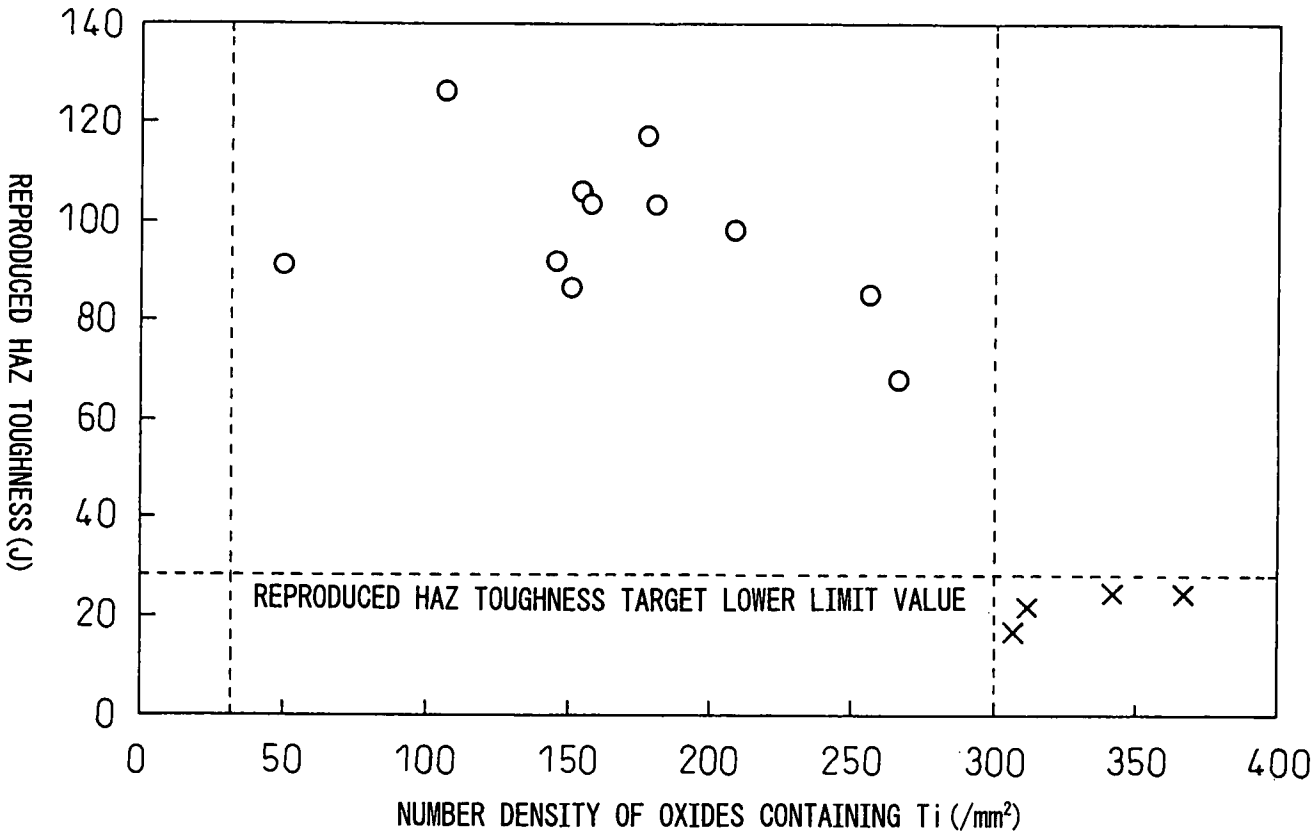
FIG. 2 is a view showing the effects of the number density distribution of Ti oxides on the toughness of the HAZ of a steel material.

FIG. 2 shows the effects of the number density distribution of Ti-based oxides of a grain size of 0.05 to 10 μm in the steel on the HAZ toughness. From FIG. 2, it is learned that to obtain a good HAZ toughness, it is necessary to include Ti-based oxides of a grain size of 0.05 to 10 μm by dispersion in a ratio of 30 to 300/mm$^2$.

Further, the inventors used rod-shaped tensile test pieces, heated them by a temperature elevation rate of 10° C./s to 1400° C. and held them there for 1 second, then cooled them to 100° C. while making the time required for cooling from 800° C. to 500° C. 10 second for HAZ reproduction heat treatment, then reheated them by a temperature elevation rate of 10° C./s to 600° C. and measured them for the draw rate, that is, reheat draw rate.

Figure 3:
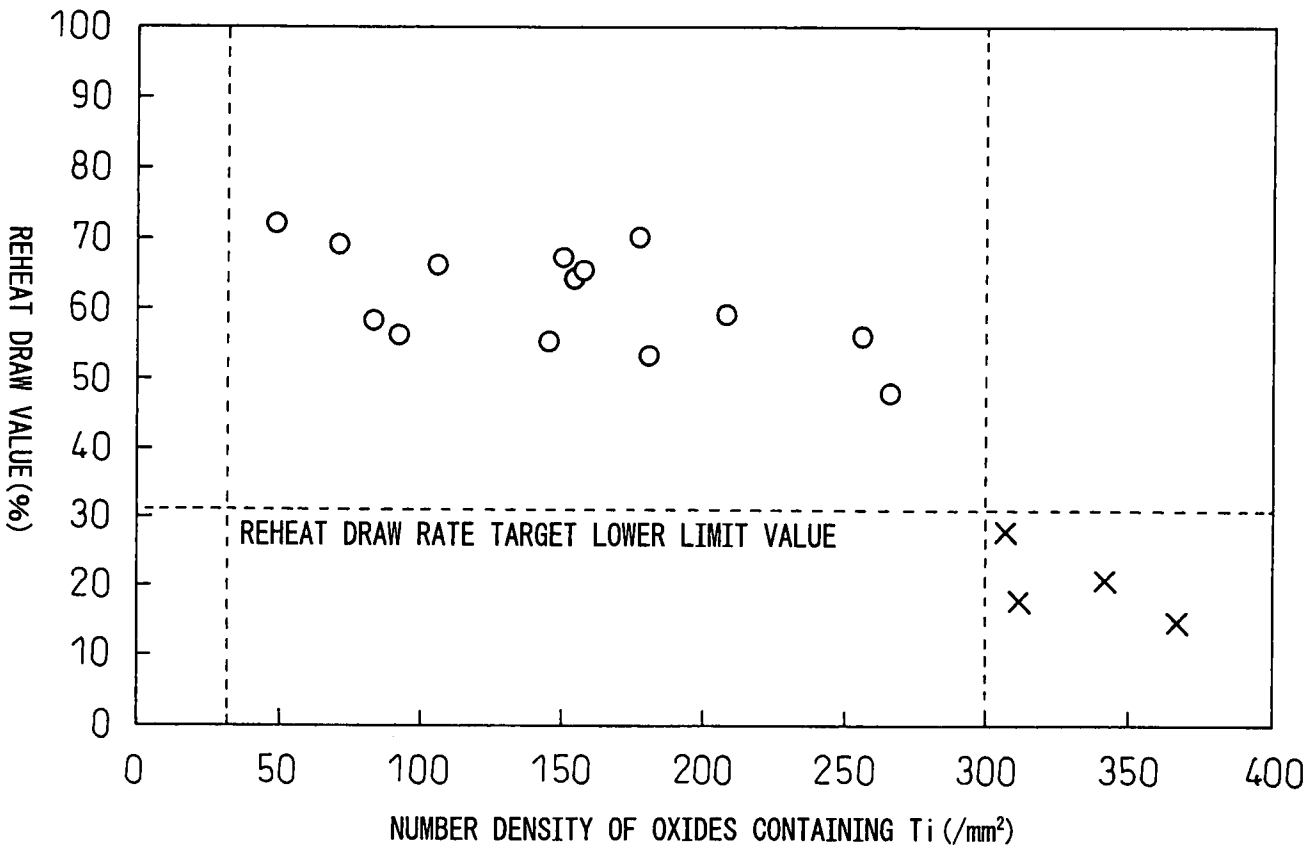
FIG. 3 is a view showing the effects of the number density distribution of Ti oxides on the reheat embrittlement characteristics of a steel material.

As a result, with a steel material superior in HAZ toughness, as shown in FIG. 3, in a steel material superior in HAZ toughness with a dispersion of Ti-based oxides in the above range, it was confirmed that a good result of a reheat draw rate of 30% or more is obtained.

Figure 4:
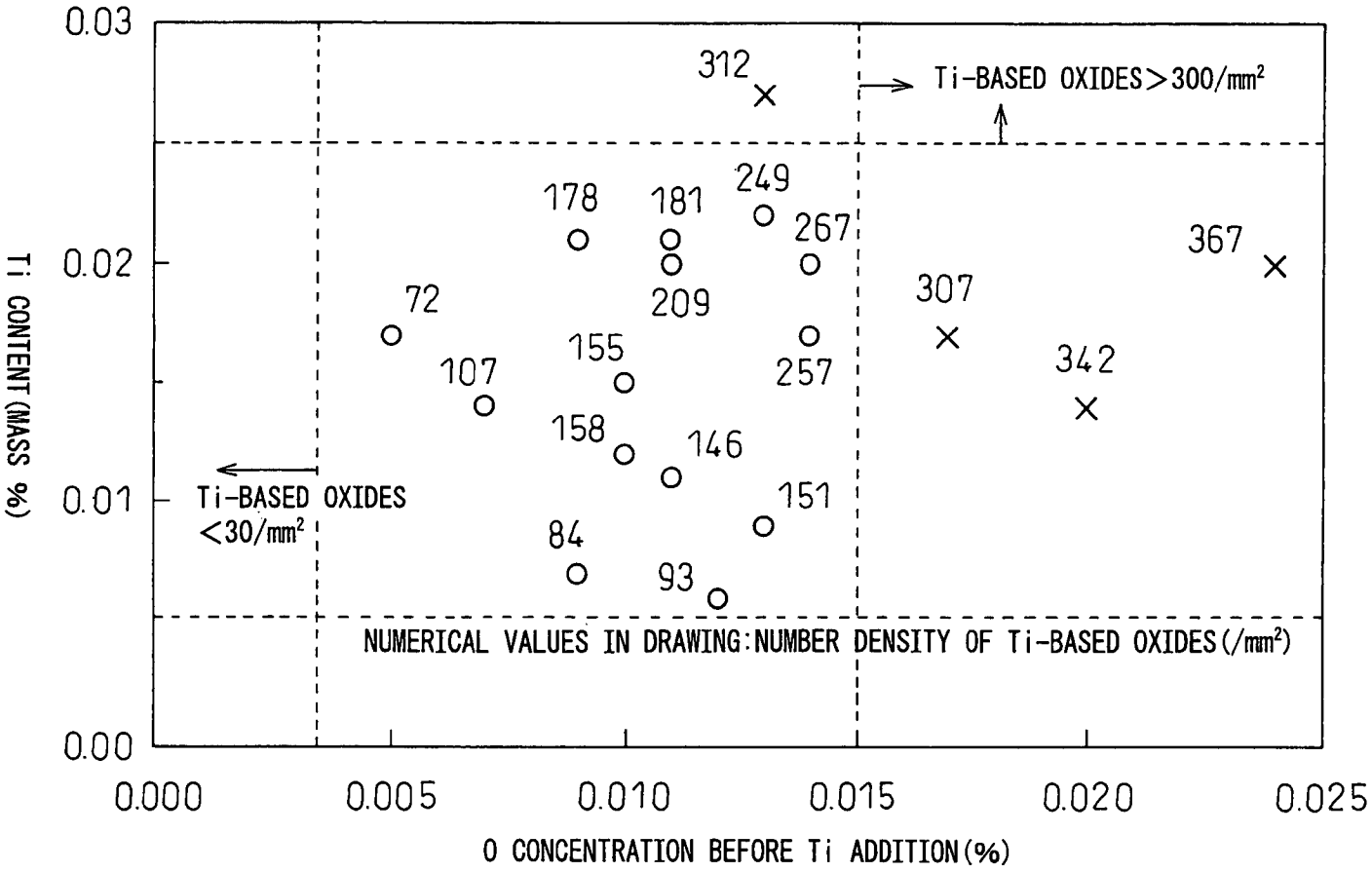
FIG. 4 is a view showing the effects of the relationship between the amount of solute oxygen before addition of Ti and the amount of Ti on the density of Ti-based oxides.

FIG. 4 shows the effects of the relationship between the amount of solute oxygen before the addition of Ti and the amount of Ti on the density of the Ti-based oxides. The numerical values of FIG. 4 show the density of Ti-based oxides of a grain size of 0.05 to 10 μm. From FIG. 4, it is learned that to obtain a steel material having a good HAZ toughness containing Ti-based oxides of a grain size of 0.05 to 10 μm in a ratio of 30 to 300/mm$^2$, it is necessary to adjust the solute oxygen before addition of Ti and after primary deoxidation to, by mass %, 0.003 to 0.015%, preferably 0.003 to 0.010%, and the content of Ti to 0.005 to less than 0.040%, preferably 0.005 to 0.020%.

In the above way, it was learned that in fire resistant shaped steel, if lowering the C and lowering the N and further optimizing the relationship of C and Nb and the grain size and number density of Ti-based oxides, the solid solution Nb is secured, coarsening of the grain size at the HAZ is suppressed, and thereby the concentrations of B and Nb segregating the grain boundaries further fall. It was learned that this is extremely effective for the prevention of reheat embrittlement.

Further, as further merits of the present system of ingredients, suitability quenchability by the addition of B is maintained and the balance of elements contributing to steel material strength and toughness is extremely good, there is almost no dependency of strength or toughness by the cooling speed in the cooling process after heating, and the variation in characteristics is extremely small, so when applied to large thickness sizes, the strength and toughness can be maintained at a high level at all part positions. It was learned that the chemical ingredients were suitable for extremely thick H-section steel.

The present invention made based on these discoveries will be explained in detail below. First, Ti-based oxides will be explained.

Grain Size and Density of Ti-based Oxides:

The present invention provides fire resistant steel which utilizes finely dispersed Ti-based oxides to suppress in particular crystal grain coarsening at the HAZ by the pinning effect and improve the HAZ toughness and reheat embrittlement characteristics. The lower limit of the grain size of the Ti-based oxides effective for pinning is 0.05 μm or more. If the grain size of the Ti-based oxides exceeds 10 μm, the oxides will form starting points of fracture and obstruct toughness.

Further, for improvement of the HAZ toughness and reheat embrittlement characteristics, 30 to 300/mm$^2$ is effective. If the density of the Ti-based oxides with a grain size of 0.05 to 10 μm is less than 30/mm$^2$, the pinning effect is insufficient. On the other hand, if the density of the Ti-based oxides with a grain size of 0.05 to 10 μm is over 300/mm$^2$, propagation of cracks will be promoted, so the HAZ toughness and the reheat embrittlement characteristics will be damaged.

Note that, "Ti-based oxides" is the general term for $TiO_2$, $Ti_2O_3$, complex oxides of these with $SiO_2$ and other Si-based oxides and $Al_2O_3$ and other Al-based oxides, and oxides containing Ti in which MnS and other sulfides and TiN and other nitrides have complexly precipitated.

The grain size and density of Ti-based oxides can be measured by a scan type electron microscope (SEM). Ti-based oxides are preferably identified by an SEM having an energy dispersion type X-ray analyzer. Ti-based oxides precipitate in the liquid phase and are not flattened in the hot rolling either, so are observed as spherical inclusions. If using an energy dispersion type X-ray analyzer, it can be confirmed if spherical inclusions are oxides containing Ti.

By using an SEM to observe several fields, preferably 20 fields or more, at 5000 to 10000×, counting the number of inclusions, and dividing them by the area of the part position observed, the density can be calculated. Note that inclusions with a grain size of less than 0.05 μm or more than 10 μm do not contribute to improvement of toughness, so are ignored when calculating the density.

Amount of Solute Oxygen Before Addition of Ti:

To ensure the presence of Ti-based oxides with a grain size of 0.05 to 10 μm and a density of 30 to 300/mm$^2$ in the steel, the amount of solute oxygen before the addition of Ti when producing the steel is important. If the amount of solute oxygen before the addition of Ti is less than 0.003%, the Ti-based oxides become smaller in grain size and fall in density. On the other hand, if the amount of solute oxygen before the addition of Ti exceeds 0.015%, the Ti-based oxides will coarsen to a grain size exceeding 10 μm and the toughness will be damaged.

Therefore, the amount of solute oxygen before the addition of Ti was made 0.003 to 0.015% in range. If performing deoxidation using Si and Mn as deoxidizing agents before adding Ti when producing the steel, the amount of solute oxygen can be made 0.003 to 0.015%.

Next, the ingredients of fire resistant steel of the present invention will be explained.

C is an element strengthening the steel. To obtain the strength required as structural steel, addition of 0.005% or more is necessary. On the other hand, if adding over 0.03% of C, coarse carbides form at the HAZ and the toughness and reheat embrittlement resistance are reduced and, further, island-shaped martensite forms between the laths of the bainite phases and the toughness of the base material falls. Therefore, the lower limit of the amount of C was made 0.005% and the upper limit was made 0.03%. Note that, from the viewpoint of securing reheat embrittlement resistance and toughness, the upper limit is preferably made 0.02%.

Si is an important deoxidizing agent in the present invention. Further, it is an element contributing to the improvement of strength as well. To make the solute oxygen of the molten steel before addition of TI 0.003 to 0.015 mass % and, further, to secure strength of the base material, addition of 0.05% or more of Si is necessary. On the other hand, if the amount of Si exceeds 0.40%, low melting point oxides will form and the descalability will deteriorate. For this reason, the amount of S is made 0.05% to 0.40%. Further, if the amount of Si exceeds 0.30%, unevenness will occur at the time of hot dipping and the beauty will be harmed. Therefore, the upper limit of the amount of Si is preferably made 0.30% or less.

Mn is an important deoxidizing agent in the present invention. Further, it is an element raising the quenchability and increasing the amount of formation of the bainite structures to contribute to the improvement of strength and toughness. To make the solute oxygen of the molten steel before addition of Ti 0.003 to 0.015 mass % and, further, to secure strength and toughness of the base material, addition of 0.40% or more is required. On the other hand, Mn is an element which easily segregates at the center of the steel slab when producing a steel slab in continuous casting. If adding over 1.70% of Mn, the quenchability of the segregated part will excessively rise and the toughness will deteriorate. Therefore, the amount of Mn is made 0.40% to 1.70%. In particular, when the amounts of addition of strengthening elements other than Mn are small, to secure strength by addition of Mn, addition of 0.80% or more is preferable.

Nb is added for securing the solid solution Nb extremely important in the present invention. By securing the solid solution Nb, the quenchability can be raised to improve the ordinary temperature strength. Further, due to the drag effect of dislocations, the deformation resistance can be increased and strength secured even in the high temperature region. To secure the solid solution Nb for expressing this effect, addition of 0.02% or more of Nb is required. On the other hand, even if adding over 0.25% of Nb, the effect is saturated, so the upper limit was made 0.25%. Further; in the present invention, since B contributes to the improvement of strength, the upper limit of the amount of addition of Nb is preferably made 0.10% or less.

Further, Nb is a powerful carbide-forming element. It fixes excessive C as NbC and prevents the decrease of the solid solution B by precipitation of $Fe_{23}CB_6$. For this reason, to improve the high temperature strength, it is necessary to satisfy $$C—Nb/7.74 \leq 0.02$$

Here, C and Nb are the contents of C and Nb in units of mass %.

The lower limit of C—Nb/7.74 can be found from the lower limit value of C and the upper limit value of Nb, so is not particularly defined.

The mass concentration product of Nb and C is an indicator of the amount of solid solution Nb. To further improve the high temperature strength, it is preferably made 0.0015 or more. The "mass concentration product of Nb and C" is the product of the contents of Nb and C expressed by mass %. The upper limit of the mass concentration product of Nb and C is found from the upper limit values of the contents of Nb and C, so is not particularly defined.

Ti is an important element for forming Ti-based oxides in this way. Further, it is an element forming carbides and nitrides and easily forms TiN stable at a high temperature. TiN is stable in the temperature region up to 1300. It fixes the N to suppress the precipitation of BN at the grain boundaries of the HAZ and contributes to the improvement of the reheat embrittlement resistance characteristics. By the formation of TiN, it is possible to suppress the precipitation of NbN, so addition of Ti is also extremely effective for securing solid solution Nb. To obtain this effect, addition of 0.005% or more of Ti is necessary. On the other hand, if adding 0.025% or more of Ti, the Ti-based oxides and TiN will coarsen and the toughness will be harmed. For this reason, the amount of Ti is made 0.005% to 0.025%. From the viewpoint of securing the amount of fine Ti-based oxides and improving the toughness, the upper limit is preferably 0.020%.

N is an impurity element forming nitrides. Reduction of the amount of N is effective for suppressing the solid solution Nb and B. The upper limit is made 0.0045% or less. The content of N is preferably extremely low, but making it less than 0.0008% increases the production costs. Further, it is preferable to make the amount of addition of Ti, a powerful nitride-forming element producing TiN stable up to the high temperature region, and the content of N a suitable relationship. In the present invention, for improvement of the ordinary temperature and high temperature mechanical characteristics, the Ti/N concentration ratio is preferably made 3.4 or more.

B is an element which, with addition in a fine amount, raises the quenchability and contributes to the rise in strength. To obtain this effect, addition of 0.0003% or more is required. On the other hand, if the amount of B exceeds 0.0030%, BN excessively precipitates and the reheat embrittlement resistance characteristics are impaired. Therefore, the amount of B is made 0.0003 to 0.0030%. However, when used for fire resistant steel, from the viewpoint of greatly reducing the reheat embrittlement, the upper limit value is made 0.0020%, more preferably 0.0015%, when used for extremely thick H-section steel, from the viewpoint of securing strength through quenchability, the upper limit value is preferably made 0.0025%.

P and S are impurities. If included in excess, weld cracks due to solidification segregation and a drop in toughness will occur. Therefore, P and S should be reduced as much as possible. The upper limits of the contents of these are made 0.030% or less and 0.020% or less.

Al is a powerful deoxidizing agent and is added to control the concentration of solute oxygen after primary deoxidation to 0.003 to 0.015%. However, if including over 0.03% of Al, island-shaped martensite is formed and the toughness is damaged, so the upper limit is made 0.030%. From the viewpoint of improvement of the toughness, the upper limit is preferably 0.02%.

In the present invention, further, this system of ingredients may have further added to it as necessary V, Mo, Zr, Hf, Cr, Cu, Ni, Mg, REM, and/or Ca so as to improve the characteristics. Below, these optionally added ingredients will be explained.

V is known as a precipitation strengthening element, but in the present invention where the C content is low, it contributes to solution strengthening. V becomes saturated in effect even if added in over 0.10% and detracts from the economy, so the upper limit is preferably made 0.10%.

Mo is an element contributing to strengthening of the structure by solution strengthening and improvement of the quenchability. It is preferable to selectively utilize strengthening by addition of Mo added in accordance with the targeted strength level. However, if adding more than 0.10%, the economy is detracted from, so the upper limit is preferably made 0.10%.

Zr is an element forming ZrN—a nitride stabler at high temperature than even TiN. By the formation of ZrN, it is possible to contribute more effectively to the reduction of the solid solution N in the steel compared even with addition of Ti alone and therefore the solid solution B and solid solution Nb can be secured. If the content of Zr is over 0.03%, coarse ZrN forms in the molten steel before casting and the ordinary temperature toughness and HAZ toughness are impaired. Therefore, the concentration of Zr is preferably made 0.03% or less. Further, by immobilizing the N, the precipitation of BN causing reheat embrittlement is suppressed and a drop in the high temperature strength and draw rate can be prevented, so addition of 0.005% or more is preferable.

Hf, like Ti, is an element forming nitrides and contributes to reduction of the solid solution N. However, if adding over 0.01% of Hf, the HAZ toughness sometimes falls. Therefore, the upper limit of Hf is preferably made 0.01%.

Cr, Cu, and Ni are elements which improve the quenchability and thereby contribute to a rise in strength. Cr and Cu, if added in excess, sometimes detract from the toughness, so their upper limits are preferably made 1.5% and 1.0%. Further, from the viewpoint of economy, the upper limit of Ni is preferably made 0.7%.

Mg is a powerful deoxidizing element and has the function of forming Mg-based oxides stable at a high temperature, not entering into solid solution in the steel even when heated to a high temperature during welding, and pinning the γ grains. Due to this, it refines the structure of the HAZ and suppresses the drop in toughness. However, if adding over 0.005% of Mg, the Mg-based oxides become coarser and no longer contribute to pinning of the γ grains. They sometimes form coarse oxides and detract from the toughness, so the upper limit is preferably made 0.005%.

REMs (rare earth elements) undergo oxidation reactions and sulfurization reactions in the steel to form oxides and sulfides. These oxides and sulfides are stable at a high temperature. They will not enter solid solution even when heated to a high temperature at the time of welding and have the function of pinning the grain boundaries. Due to this function, it is possible to refine the HAZ structure and suppress the drop in toughness. To obtain this effect, addition of a total content of all rare earth elements of 0.001% or more is preferable. On the other hand, if adding REMs over 0.01%, the volume fraction of the oxides and sulfides becomes higher and the toughness is sometimes lowered, so the upper limit is preferably made 0.01%.

Ca, by addition in a small amount, has the effect of suppressing flattening of the sulfides in the rolling direction during hot rolling. Due to this, the toughness is improved, in particular, this contributes to an improvement of the Charpy value in the thickness direction. To obtain this effect, addition of 0.001% or more of Ca is preferable. On the other hand, if adding over 0.005% of Ca, the volume fraction of the oxides and sulfides will become higher and the toughness will be lowered in some cases, so the upper limit is preferably made 0.005%.

The metal structure of the steel of the present invention is not particularly limited, but the contents of the elements raising the quenchability should be adjusted to obtain a structure in accordance with the required strength. To raise the strength, raising the area ratio of one or both of the massive ferrite or bainite is preferable.

Massive ferrite is a structure resulting from the diffusion and transformation of austenite to ferrite of the same composition in the cooling process. Since the compositions before and after the transformation are the same, not the diffusion of C, but the self diffusion of the Fe atoms, that is, the rearrangement of the lattice, becomes the speed setting stage. Therefore, the massive ferrite is formed with a short distance of movement of atoms and a relatively fast transformation speed, so the crystal grain size becomes larger than polygonal ferrite and the dislocation density is high.

The massive ferrite formed by this mechanism differs from the polygonal ferrite in crystal grain size under observation of the structure under an optical microscope, but is no different in form. Therefore, to clearly differentiate these, observation by a through type electron microscope is necessary. Further, bainite forms plate structures and can be distinguished from massive ferrite and polygonal ferrite by an optical microscope. Note that, in addition to massive ferrite, bainite, and polygonal ferrite, small amounts of martensite, residual austenite, and pearlite are sometimes also formed.

The formation of massive ferrite and bainite is promoted by raising the quenchability of steel. For this reason, making the quenchability indicator Ceq 0.05 or more is preferable. Further, if Ceq is too high, the strength rises and the toughness is sometimes impaired, so the upper limit is more preferably made 0.60 or less. Note that, $$Ceq=C+Si/24+Mn/6+Ni/40+Cr/5+Mo/4+V/14$$

where C, Si, Mn, Ni, Cr, Mo, and V are the contents of the elements [mass %].

Next, the method of production will be explained.

Steel, as explained above, is produced using Si and Mn as deoxidizing agents and adjusting the amount of solute oxygen before the addition of Ti and then is cast into steel slabs. From the viewpoint of productivity, continuous casting is preferable.

The obtained steel slab is hot rolled into steel plate or shaped steel and then cooled. Note that, the steel material covered by the present invention includes rolled steel plate, H-section steel, I-section steel, angle steel, channel steel, unequal angle steel, and other shaped steel. Among these, for building materials where fire resistance and reheat embrittlement resistance characteristics are required, in particular H-section steel is suitable. Further, when used as column materials, steel material of a thickness of a large size such as extremely thick H-section steel is suitable.

To obtain a steel material of the present invention containing Ti-based oxides with a grain size of 0.05 to 10 μm in a ratio of 30 to 300/mm$^2$, adjustment of the solute oxygen before the addition of Ti and after primary deoxidation is extremely important. It is necessary to adjust the amount of solute oxygen to a mass % of 0.003 to 0.015%. To form the Ti-based oxides, a 0.003% or more amount of solute oxygen is necessary. If over 0.015%, the grain size of the Ti oxides becomes larger, so a sufficient number of oxides of a grain size of 0.05 to 10 μm can no longer be obtained. From this viewpoint, the upper limit of the solute oxygen is preferably made 0.010%.

When hot rolling to produce a steel material, to facilitate plastic deformation and ensure the Nb sufficiently enters solid solution, the lower limit of the heating temperature of the steel slab has to be made 1100° C. Further, when hot working to produce shaped steel, to further facilitate plastic deformation, the heating temperature is preferably made 1200° C. or more. The upper limit of the heating temperature of the steel slab was made 1350° C. in view of the performance of the heating furnace and economy. To refine the microstructure of the steel, the upper limit of the heating temperature of the steel slab is preferably made 1300° C.

In the hot rolling, the cumulative reduction rate at 1000° C. and below is preferably made 30% or more. Due to this, recrystallization during the hot working is promoted, the γ grains are made finer, and the toughness and strength can be improved. When the thickness is over 40 mm, due to restrictions in thickness of the material before rolling, securing a cumulative reduction rate is sometimes difficult. In the case, by securing a cumulative reduction rate at 1000° C. and below of 10% or more, the strength can be improved. However, the preferably cumulative reduction rate range is 30% or more.

Further, by ending the hot working in the temperature range where the structure of the steel is the single austenite phase (meaning γ single phase region) or ending it in the state where the volume fraction of the ferrite formed by the phase transformation is low, it is possible to avoid a remarkable rise in the yield strength, drop in toughness, anisotropy of toughness, and other deterioration of the mechanical characteristics. Therefore, the end temperature of the hot rolling is preferably made 800° C. or more.

Further, after hot rolling, controlled cooling is preferably used to make the average cooling speed in the 800 to 500° C. temperature range 0.1 to 10° C./s. To use controlled cooling after hot rolling to improve the strength and toughness of a steel material further, the average cooling speed in the 800 to 500° C. temperature range is preferably made 0.1° C./s or more. On the other hand, if the average cooling speed of 800 to 500° C. in temperature range is over 10° C./s, the structural fraction of the bainite phase or martensite phase rises and the toughness sometimes drops, so the upper limit is preferably made 10° C./s.

EXAMPLES

Molten steels produced in converters were charged with alloys, then continuously cast to prepare steel slabs of 250 to 300 mm thickness comprised of the ingredients shown in Table 1. Table 1 shows the amount of solute oxygen before addition of Ti (mass %). Further, blank fields in Table 1 mean no optional elements were added.

TABLE 1

| Steel | Ingredients (mass %) | | | | | | | | | | | |
|---|---|---|---|---|---|---|---|---|---|---|---|---|
| no. | C | Si | Mn | P | S | Nb | N | B | Al | Ti | V, Mo | Zr, Hf |
| A | 0.010 | 0.15 | 1.52 | 0.005 | 0.006 | 0.02 | 0.0019 | 0.0011 | 0.02 | 0.017 | | |
| B | 0.008 | 0.20 | 1.55 | 0.004 | 0.004 | 0.06 | 0.0018 | 0.0015 | 0.02 | 0.021 | | |
| C | 0.020 | 0.25 | 0.88 | 0.005 | 0.006 | 0.08 | 0.0022 | 0.0012 | 0.03 | 0.015 | | |
| D | 0.031 | 0.20 | 1.41 | 0.009 | 0.006 | 0.15 | 0.0030 | 0.0006 | 0.02 | 0.020 | | |
| E | 0.011 | 0.25 | 1.51 | 0.010 | 0.011 | 0.04 | 0.0029 | 0.0011 | 0.02 | 0.020 | Mo: 0.10 | |
| F | 0.011 | 0.15 | 1.55 | 0.008 | 0.009 | 0.05 | 0.0017 | 0.0012 | 0.02 | 0.006 | V: 0.04 | |
| G | 0.020 | 0.08 | 1.53 | 0.008 | 0.006 | 0.05 | 0.0023 | 0.0008 | 0.01 | 0.017 | | Zr: 0.02 |
| H | 0.011 | 0.18 | 1.49 | 0.009 | 0.005 | 0.04 | 0.0025 | 0.0005 | 0.02 | 0.022 | | Hf: 0.01 |
| I | 0.009 | 0.20 | 1.05 | 0.015 | 0.006 | 0.02 | 0.0022 | 0.0007 | 0.03 | 0.021 | | |
| J | 0.020 | 0.15 | 1.50 | 0.011 | 0.007 | 0.06 | 0.0035 | 0.0009 | 0.03 | 0.014 | | |
| K | 0.009 | 0.20 | 1.21 | 0.017 | 0.013 | 0.02 | 0.0028 | 0.0008 | 0.02 | 0.012 | | |
| L | 0.010 | 0.25 | 1.60 | 0.014 | 0.008 | 0.08 | 0.0025 | 0.0011 | 0.02 | 0.009 | Mo: 0.10 | |
| M | 0.020 | 0.15 | 1.51 | 0.011 | 0.008 | 0.17 | 0.0018 | 0.0009 | 0.03 | 0.007 | V: 0.08 | |
| N | 0.030 | 0.35 | 0.65 | 0.017 | 0.012 | 0.10 | 0.0029 | 0.0015 | 0.01 | 0.011 | | Zr: 0.01 |
| O | 0.015 | 0.25 | 1.50 | 0.015 | 0.004 | 0.06 | 0.0025 | 0.0016 | 0.02 | 0.015 | | |
| P | 0.009 | 0.20 | 1.55 | 0.009 | 0.009 | 0.08 | 0.0024 | 0.0008 | 0.02 | 0.017 | | |
| Q | 0.018 | 0.15 | 1.47 | 0.011 | 0.008 | 0.10 | 0.0020 | 0.0002 | 0.01 | 0.014 | | |
| R | 0.021 | 0.25 | 1.39 | 0.015 | 0.006 | 0.15 | 0.0038 | 0.0012 | 0.01 | 0.027 | | |
| S | 0.042 | 0.20 | 1.21 | 0.013 | 0.009 | 0.08 | 0.0022 | 0.0007 | 0.01 | 0.013 | | |
| TT | 0.018 | 0.20 | 1.33 | 0.013 | 0.005 | 0.02 | 0.0027 | 0.0033 | 0.01 | 0.008 | | |
| U | 0.009 | 0.15 | 1.55 | 0.015 | 0.007 | 0.02 | 0.0050 | 0.0007 | 0.01 | 0.020 | | |
| V | 0.030 | 0.15 | 1.48 | 0.011 | 0.005 | 0.01 | 0.0042 | 0.0006 | 0.02 | 0.014 | | |
| W | 0.017 | 0.20 | 1.50 | 0.011 | 0.005 | 0.02 | 0.0027 | 0.0017 | 0.02 | 0.008 | | |
| X | 0.014 | 0.23 | 1.57 | 0.008 | 0.005 | 0.05 | 0.0024 | 0.0031 | 0.02 | 0.004 | V: 0.06<br>Mo: 0.06 | |
| Y | 0.009 | 0.25 | 1.53 | 0.010 | 0.004 | 0.05 | 0.0029 | 0.0020 | 0.02 | 0.015 | V: 0.05<br>Mo: 0.06 | |

TABLE 1-continued

| | | | | | | | | | | | |
|---|---|---|---|---|---|---|---|---|---|---|---|
| Z | 0.009 | 0.38 | 1.61 | 0.009 | 0.004 | 0.05 | 0.0019 | 0.0016 | 0.02 | 0.017 | V: 0.06<br>Mo: 0.07 |
| AA | 0.011 | 0.38 | 1.63 | 0.010 | 0.004 | 0.05 | 0.0018 | 0.0024 | 0.02 | 0.017 | V: 0.06 |
| AB | 0.010 | 0.25 | 1.45 | 0.009 | 0.003 | 0.05 | 0.0028 | 0.0028 | 0.02 | 0.013 | V: 0.05<br>Mo: 0.06 |
| AC | 0.018 | 0.23 | 1.59 | 0.010 | 0.006 | 0.05 | 0.0028 | 0.0021 | 0.00 | 0.015 | Mo: 0.06 |

| Steel no. | Ingredients (mass %) Cr, Cu, Ni | Mg, Ca, REM | C − Nb/7.74 | Solute O before Ti addition | Ti-based oxides/ $\mu m^2$ | Remarks |
|---|---|---|---|---|---|---|
| A | | | 0.007 | 0.005 | 72 | Inv. |
| B | | | 0.002 | 0.011 | 181 | steel |
| C | | | 0.010 | 0.010 | 155 | |
| D | | | 0.011 | 0.14 | 267 | |
| E | | | 0.005 | 0.011 | 209 | |
| F | | | 0.004 | 0.012 | 93 | |
| G | | | 0.014 | 0.014 | 257 | |
| H | | | 0.005 | 0.013 | 249 | |
| I | Cr: 1.0 | | 0.007 | 0.009 | 178 | |
| J | Cu: 0.8, Ni: 0.5 | | 0.012 | 0.007 | 107 | |
| K | Cr: 1.0, Cu: 0.3, Ni: 0.3 | | 0.007 | 0.010 | 158 | |
| L | | Mg: 0.004 | 0.000 | 0.013 | 151 | |
| M | Cu: 0.5, Ni: 0.5 | | −0.002 | 0.009 | 84 | |
| N | Cr: 1.5 | | 0.017 | 0.011 | 146 | |
| O | | Ca: 0.004, REM: 0.007 | 0.007 | 0.009 | 123 | |
| P | | | −0.001 | 0.017 | 307 | Comp. |
| Q | | | 0.005 | 0.020 | 342 | steel |
| R | | | 0.001 | 0.013 | 312 | |
| S | Cu: 0.5, Ni: 0.3 | | 0.032 | 0.011 | 186 | |
| TT | | | 0.015 | 0.010 | 155 | |
| U | | | 0.007 | 0.025 | 367 | |
| V | | | 0.029 | 0.015 | 243 | |
| W | | | 0.014 | 0.015 | 156 | Inv. steel |
| X | Cr: 0.23<br>Cu: 0.34<br>Ni: 0.24 | | 0.008 | 0.010 | 37 | Comp. steel |
| Y | Cr: 0.20<br>Cu: 0.34<br>Ni: 0.24 | | 0.003 | 0.005 | 56 | Inv. steel |
| Z | | | 0.003 | 0.008 | 63 | |
| AA | Cu: 0.34<br>Ni: 0.35 | | 0.005 | 0.006 | 66 | |
| AB | Cr: 0.20<br>Cu: 0.33<br>Ni: 0.23 | Ca: 0.0006 | 0.004 | 0.012 | 109 | |
| AC | Cr: 0.20<br>Cu: 0.31<br>Ni: 0.23 | | 0.012 | 0.010 | 155 | |

Figure 5:
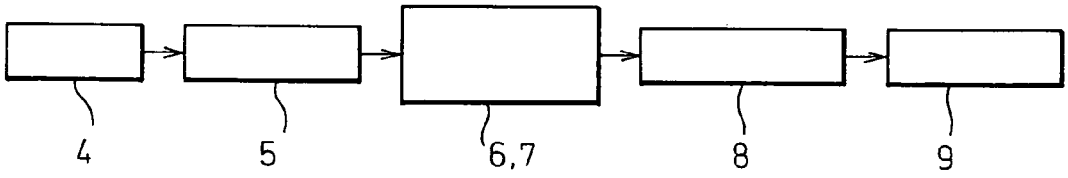
FIG. 5 is a schematic view of a process for production of shaped steel as an example of the layout of facilities for working the method of the present invention.

Each obtained steel slab was hot rolled under the conditions shown in Table 2 to obtain H-section steel. FIG. 5 shows the process of production of shaped steel. The steel slab heated by a heating furnace 4 was rough rolled by a rough rolling mill 5, then rolled to H-section steel by a universal rolling mill train comprised of an intermediate universal rolling mill 6 and finish universal rolling mill 8. Water cooling was performed between the rolling passes by water cooling apparatuses 7 provided before and after the intermediate universal rolling mill 6. The outside surface of the flange was repeatedly spray cooled and reverse rolled. The cooling after the hot rolling was performed by a cooling apparatus 9 set behind the finishing universal rolling mill 8.

Further, the steels D, G, and L of Table 1 were further hot rolled under the conditions of Table 3, while the steels F and L were further hot rolled under the conditions of Table 4.

Figure 6:
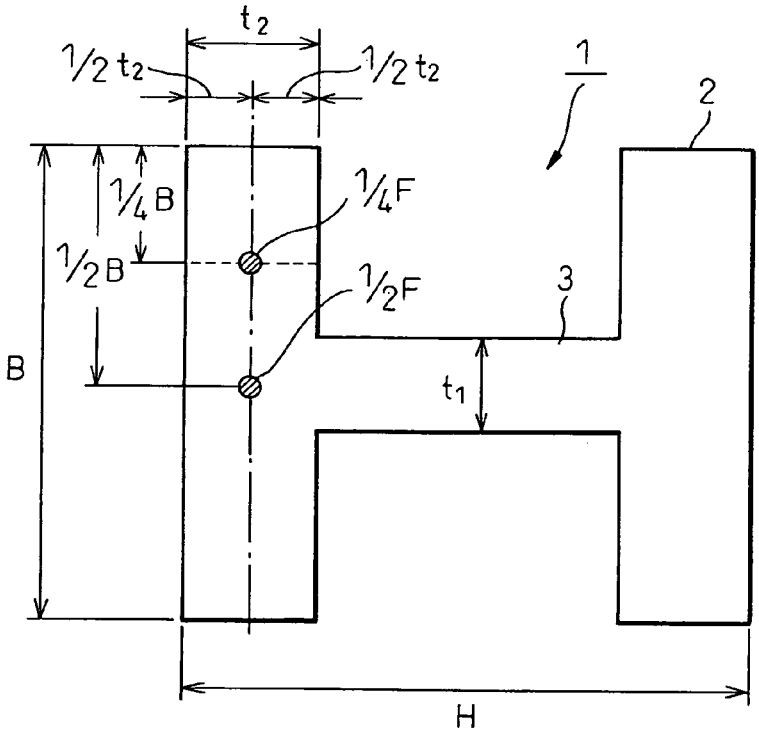
FIG. 6 is a view showing the cross-sectional shape of H-section steel and the position of sampling a mechanical strength test piece.

In the obtained H-section steel, as shown in FIG. 6, tensile test pieces were taken at the center part of thickness $t_2$ of the flange 2 ($\frac{1}{2}t_2$) at the positions of ¼ of the total flange width (B) (called "flange") and ½ (called "fillet") based on the JIS Z 2201.

The ordinary temperature tensile test was performed based on JIS Z 2241, while the 600° C. 0.2% proof stress was measured based on JIS G 0567. Note that the characteristics of these locations were found because those portions are representative portions in the cross-section of H-section steel and can show the average mechanical characteristics of H-section steel and variations in the cross-sections.

The Charpy impact test (Tables 2 to 4) was performed on small pieces taken from the fillet based on the representative test method of JIS Z 2242 at 0° C.

When used as fire resistant steel, the reheat draw rate of the reproduced weld heat affected zone (HAZ) (Tables 2 to 4) is an important characteristic. This was evaluated by subjecting the test steel to a weld heat cycle, heating it again, applying tensile stress at a high temperature, and using the draw rate when breaking. That is, a rod shaped tensile test piece taken from the flange was held at 1400° C. for 1 second, then cooled down to 100° C. with a cooling time from 800° C. to 500° C. of 20 seconds as a weld heat cycle, then was further heated as is by a 1° C./s temperature elevation rate to 600° C., held at 600° C. for 600 seconds, then given tensile strength to breakage by a 0.5 MPa/s tensile increase rate and measured for draw rate.

The toughness of the reproduced weld heat affected zone (HAZ) (Table 2), in the same way as the reheat draw rate, was evaluated by subjecting the test steel to a weld heat cycle, then applying a Charpy impact test based on JIS Z 2242 at 0° C. and finding the absorbed energy. That is, V-notch test pieces were taken from small pieces heat treated by holding them at 1400° C. for 1 second, then cooling down to 100° C. with a cooling time from 800° C. to 500° C. of 20 seconds as a weld heat cycle and were used for a Charpy impact test.

As the strength classes demanded from steel, in fire resistant steel materials, there are two types. One is the ordinary temperature tensile strength of the 400 MPa class defined as SM400, while the other is the ordinary temperature tensile strength of the 490 MPa class defined as SM490. These are shown separately. On the other hand, extremely thick H-section steel is mostly based on the U.S. ASTM standard and is shown divided into the representative strength classes of Grade 50 and Grade 65.

Note that, the targets of the JIS standard SM400, that is, the over TS400 MPa class, are an ordinary temperature yield strength YP of 235 MPa or more, preferably 355 MPa or less, a tensile strength TS of 400 to 510 MPa, and a 600° C. 0.2% proof stress PS of 157 MPa or more. The targets of SM490, that is, the over TS490 MPa class, are a YP of 325 MPa or more, preferably 445 MPa or less, a TS of 490 to 610 MPa, and a PS of 217 MPa or more. Further, in both the SM400 class and SM490 class, the target value is the 0° C. impact absorption energy is 100 J or more and the preferable upper limit of the yield ratio YP/TS is 0.80.

Further, for the ASTM standard, with the Grade 50, the YP is 345 MPa or more and the TS is 450 MPa or more, while with the Grade 65, the YP is 450 MPa or more and the TS is 550 MPa or more. In addition to the above, regarding the toughness, in each case, an impact absorption energy at the fillet part of the base material at the Charpy test temperature of 0° C. is preferably 54 J or more.

Regarding the reproduced HAZ characteristics, in each standard, the target of the reheat draw rate is 30% or more and the target of the toughness is 27 J or more. In particular, when evaluated as fire resistant steel, a reheat draw rate of 50% or more is preferable.

TABLE 2

| Prod. no. | Steel no. | Strength Class | Heating temp. (° C.) | Cumulative reduction rate at 1000° C. and below (%) | Average cooling rate at 800 to 500° C. (° C./s) | Flange thickness size (mm | Ordinary temperature mechanical characteristics Yield strength YP (MPa) | Tensile strength TS (MPa) |
|---|---|---|---|---|---|---|---|---|
| 1 | A | SM400 | 1300 | 38 | Slow | 21 | 341 | 461 |
| 2 | B | SM490 | | 39 | cooling | 18 | 401 | 531 |
| 3 | C | SM400 | | 36 | (0.05~1.0° C./s) | 24 | 361 | 477 |
| 4 | D | SM490 | | 31 | | 37 | 425 | 554 |
| 5 | E | SM400 | | 38 | | 21 | 349 | 495 |
| 6 | F | SM490 | | 38 | | 21 | 410 | 533 |
| 7 | G | SM400 | | 36 | | 24 | 379 | 488 |
| 8 | H | SM400 | | 38 | | 21 | 326 | 426 |
| 9 | I | SM400 | | 36 | | 24 | 332 | 410 |
| 10 | J | SM490 | | 33 | | 32 | 421 | 521 |
| 11 | K | SM400 | | 38 | | 21 | 309 | 425 |
| 12 | L | SM490 | | 40 | | 15 | 422 | 567 |
| 13 | M | SM490 | | 38 | | 21 | 398 | 551 |
| 14 | N | SM490 | | 34 | | 28 | 387 | 591 |
| 15 | O | SM490 | | 34 | | 28 | 407 | 558 |
| 16 | P | SM400 | 1300 | 36 | Slow | 24 | 311 | 441 |
| 17 | Q | SM400 | | 38 | cooling | 21 | 275 | 391 |
| 18 | R | SM400 | | 34 | (0.05~1.0° C./s) | 28 | 305 | 377 |
| 19 | S | SM490 | | 38 | | 21 | 441 | 609 |
| 20 | TT | SM490 | | 31 | | 37 | 433 | 601 |
| 21 | U | SM490 | | 38 | | 21 | 411 | 558 |
| 22 | V | SM400 | | 36 | | 24 | 287 | 380 |
| 36 | D | Grade 50 | 1300 | 11 | Slow | 90 | 378 | 536 |
| 37 | F | Grade 50 | | 11 | cooling | 90 | 398 | 531 |
| 38 | U | Grade 50 | | 11 | (0.05~1.0° C./s) | 90 | 363 | 530 |
| 39 | W | Grade 65 | | 11 | | 90 | 452 | 601 |
| 40 | X | Grade 65 | | 5 | | 125 | 464 | 612 |
| 41 | Y | Grade 65 | | 5 | | 125 | 471 | 583 |
| 42 | Z | Grade 65 | | 5 | | 125 | 457 | 579 |
| 43 | AA | Grade 65 | | 5 | | 125 | 499 | 613 |
| 44 | AB | Grade 65 | | 11 | | 90 | 454 | 575 |
| 45 | AC | Grade 65 | | 11 | | 90 | 463 | 605 |

TABLE 2-continued

| Prod. no. | Ordinary temperature mechanical characteristics: Yield ratio YP/TS | 0° C. impact absorption energy (J) | Reproduced HAZ toughness (J) | High temperature mechanical characteristics: 600° C. 0.2% PS (MPa) | Reproduced HAZ reheat embrittlement draw rate (%) | Remarks |
|---|---|---|---|---|---|---|
| 1 | 0.74 | 354 | 214 | 177 | 69 | Inv. |
| 2 | 0.76 | 284 | 103 | 219 | 53 | steel |
| 3 | 0.76 | 311 | 106 | 167 | 64 | |
| 4 | 0.77 | 245 | 68 | 225 | 72 | |
| 5 | 0.71 | 324 | 98 | 181 | 59 | |
| 6 | 0.77 | 291 | 165 | 220 | 56 | |
| 7 | 0.78 | 298 | 85 | 191 | 71 | |
| 8 | 0.77 | 381 | 91 | 164 | 67 | |
| 9 | 0.81 | 354 | 117 | 160 | 70 | |
| 10 | 0.81 | 234 | 126 | 222 | 66 | |
| 11 | 0.73 | 361 | 103 | 161 | 65 | |
| 12 | 0.74 | 301 | 86 | 234 | 67 | |
| 13 | 0.72 | 266 | 157 | 221 | 58 | |
| 14 | 0.65 | 321 | 92 | 240 | 55 | |
| 15 | 0.73 | 298 | 108 | 237 | 49 | |
| 16 | 0.71 | 322 | 17 | 160 | 15 | Comp. |
| 17 | 0.70 | 341 | 25 | 134 | 45 | steel |
| 18 | 0.81 | 297 | 22 | 127 | 50 | |
| 19 | 0.72 | 87 | 77 | 211 | 31 | |
| 20 | 0.72 | 25 | 114 | 227 | 16 | |
| 21 | 0.74 | 362 | 25 | 220 | 21 | |
| 22 | 0.76 | 355 | 98 | 205 | 18 | |
| 36 | 0.71 | 301 | 146 | 219 | 32 | Inv. |
| 37 | 0.75 | 89 | 201 | 225 | 34 | steel |
| 38 | 0.68 | 38 | 189 | 225 | 19 | Comp. steel |
| 39 | 0.75 | 289 | 102 | 305 | 31 | Inv. steel |
| 40 | 0.76 | 21 | 20 | 324 | 8 | Comp. steel |
| 41 | 0.81 | 175 | 121 | 289 | 33 | Inv. |
| 42 | 0.79 | 271 | 296 | 296 | 38 | steel |
| 43 | 0.81 | 90 | 102 | 289 | 31 | |
| 44 | 0.79 | 95 | 269 | 286 | 30 | |
| 45 | 0.77 | 224 | 241 | 301 | 31 | |

TABLE 3

| Prod. no. | Steel no. | Strength Class | Cumulative reduction rate at 1000° C. and below (%) | Flange thickness size (mm | Ordinary temperature mechanical characteristics: Yield strength YP (MPa) | Tensile strength TS (MPa) | Yield ratio YP/TS | 0° C. impact absorption energy (J) *1 | High temperature mechanical characteristics: 600° C. 0.2% PS (MPa) | Reproduced HAZ reheat embrittlement draw rate (%) *2 | Remarks |
|---|---|---|---|---|---|---|---|---|---|---|---|
| 23 | D | SM490 | 35 | 37 | 440 | 560 | 0.79 | 268 | 227 | 70 | Inv. |
| 24 | | | 31 | | 425 | 554 | 0.77 | 245 | 225 | 72 | steel |
| 25 | | | 27 | | 405 | 531 | 0.76 | 233 | 218 | 70 | |
| 26 | G | SM400 | 36 | 24 | 379 | 488 | 0.78 | 298 | 191 | 71 | |
| 27 | | | 31 | | 362 | 464 | 0.78 | 289 | 165 | 70 | |
| 28 | | | 28 | | 358 | 459 | 0.78 | 243 | 158 | 67 | |
| 29 | J | SM490 | 33 | 32 | 421 | 521 | 0.81 | 234 | 222 | 66 | |
| 30 | | | 25 | | 409 | 515 | 0.79 | 215 | 217 | 67 | |
| 46 | D | Grade 50 | 6 | 90 | 369 | 531 | 0.69 | 256 | 231 | 31 | |
| 47 | | | 11 | | 378 | 536 | 0.71 | 301 | 219 | 32 | |
| 48 | | | 16 | | 392 | 541 | 0.72 | 289 | 225 | 33 | |
| 49 | Z | Grade 65 | 15 | 125 | 491 | 603 | 0.81 | 221 | 276 | 32 | |
| 50 | | | 10 | | 477 | 598 | 0.80 | 302 | 287 | 31 | |
| 51 | | | 5 | | 457 | 579 | 0.79 | 271 | 296 | 38 | |

TABLE 4

| Prod. no. | Steel no. | Strength Class | Cumulative reduction rate at 1000° C. and below (%) | Flange thickness size (mm | Ordinary temperature mechanical characteristics: Yield strength YP (MPa) | Tensile strength TS (MPa) | Yield ratio YP/TS | 0° C. impact absorption energy (J) *1 | High temperature mechanical characteristics: 600° C. 0.2% PS (MPa) | Reproduced HAZ reheat embrittlement draw rate (%) *2 | Remarks |
|---|---|---|---|---|---|---|---|---|---|---|---|
| 31 | F | SM490 | 7 | 12 | 446 | 596 | 0.75 | 368 | 255 | 61 | Inv. |
| 32 | | | 0.5 | 21 | 410 | 533 | 0.77 | 291 | 220 | 56 | steel |
| 33 | | | 0.07 | 35 | 397 | 503 | 0.79 | 278 | 219 | 52 | |
| 34 | L | SM490 | 0.9 | 15 | 422 | 567 | 0.74 | 301 | 234 | 67 | |
| 35 | | | 0.08 | | 388 | 501 | 0.77 | 271 | 220 | 63 | |
| 52 | Y | Grade 65 | 0.3 | 125 | 493 | 614 | 0.80 | 265 | 313 | 35 | |
| 53 | | | 0.03 | | 471 | 583 | 0.81 | 175 | 289 | 33 | |

As shown in Table 2, each of the steels of the Production Nos. 1 to 15, 36, 37, 39, and 41 to 45 of the present invention has ordinary temperature mechanical characteristics and high temperature mechanical characteristics within the target value ranges. Further, the yield point is the lower limit value of the JIS standard or more, while the yield ratio YP/TS is 0.8 or less or within the preferable range. Furthermore, the Charpy impact value at 0° C. obtained is a value of the target value or more. Furthermore, the reheat draw rate of the reproduced weld heat affected zone of 30% or more is sufficiently satisfied.

On the other hand, each of the comparative steels, that is, the steels of Production Nos. 16 to 22 and 40, has ingredients C—Nb/7.74 and a density of Ti-based oxides outside the range of the present invention, so the mechanical characteristics satisfying the target are not obtained.

As shown in Table 3, in the case of H-section steel with a flange thickness of less than 40 mm, if making the cumulative reduction rate at 1000° C. and below 30% or more, the mechanical characteristics become better than when the cumulative reduction rate is less than 30%.

Further, in the case of extremely thick H-section steel of a flange thickness of 40 mm or more, as shown in Production Nos. 46 to 51 showing the case of a flange thickness of 125 mm, along with the increase in the cumulative reduction rate at 1000° C. and below, both the yield strength and the tensile strength rise. With a cumulative reduction rate of 10% or more, the strength required as Grade 65 can further be sufficiently satisfied.

As shown in Table 4, when the flange is less than 40 mm, using water cooling to cool acceleratedly between 800 to 500° C. by a cooling speed of 10° C./s, compared with using natural cooling etc. to slowly cool between 800 to 500° C. by 0.1° C./s, enables the ordinary temperature strength and the high temperature strength to be raised.

Further, in the extremely thick H-section steel, as shown in Production Nos. 52 to 53 showing the case of a flange thickness of a size of 125 mm as a representative example, by acceleratedly cooling from 800 to 500° C. by water cooling up to 0.13° C./s, both the yield strength and the tensile strength rise and the strength required as grade 65 can be further sufficiently satisfied.

Industrial Applicability

According to the present invention, a fire resistant steel material having sufficient ordinary temperature strength and high temperature strength and superior in HAZ toughness and reheat embrittlement resistance characteristics, in particular, fire resistant H-section steel, can be produced without cold working and heat treatment for thermal refining. Due to this, it is possible to reduce installation costs, shorten the work period, and thereby greatly cut costs. The improvement in the reliability of large buildings, guarantee of safety, economy, and other industrial effects are extremely remarkable.

The invention claimed is:

1. A steel material comprising, by mass %,

C: 0.005% to 0.03%,

Si: 0.05% to 0.40%,

Mn: 0.40% to 1.70%,

Nb: 0.02% to 0.10%,

Ti: 0.005% to 0.025%,

N: 0.0008% to 0.0045%, and

B: 0.0003% to 0.0030%, restricting

P: 0.030% or less,

S: 0.020% or less, and Al: 0.02% or less, and having a balance of Fe and unavoidable impurities, where the contents of C and Nb satisfy $$0.008 \leq C—Nb/7.74 \leq 0.02$$

and Ti-based oxides of a grain size of 0.05 to 10 μm are present in a density of 30 to 300/mm$^2$, wherein the steel material is produced by a method comprising adjusting solute oxygen to within a range of from 0.003 to 0.015 mass % before the addition of Ti.

2. The steel material according to claim 1 further comprises, by mass %, one or both of V: 0.10% or less and Mo: 0.10% or less.

3. The steel material according to claim 1 further comprises, by mass %, one or more of Zr: 0.03% or less and Hf: 0.01% or less.

4. The steel material according to claim 1 further comprises, by mass %, one or more of Cr: 1.5% or less, Cu: 1.0% or less, and Ni: 0.7% or less.

5. The steel material according to claim 1 further comprises, by mass %, one or more of Mg: 0.005% or less, REM: 0.01% or less, and Ca: 0.005% or less.

6. The steel material according to claim 1, wherein a mass concentration product of Nb and C is 0.0015 or more.

7. The steel material according to claim 1, wherein the steel material is a fire resistant steel material having a heat draw rate of 30% or more.

8. The steel material according to claim 1, wherein the steel material is an extremely thick H-section steel with a flange thickness of 40 mm or more.

* * * * *

UNITED STATES PATENT AND TRADEMARK OFFICE

CERTIFICATE OF CORRECTION

PATENT NO. : 9,023,158 B2
APPLICATION NO. : 12/450651
DATED : May 5, 2015
INVENTOR(S) : Suguru Yoshida et al.

It is certified that error appears in the above-identified patent and that said Letters Patent is hereby corrected as shown below:

Specification

Column 7, line 48, change "addition of TI 0.003 to 0.015 mass%" to -- addition of Ti 0.003 to 0.015% --.

Signed and Sealed this
Twenty-third Day of February, 2016

Michelle K. Lee

Michelle K. Lee
*Director of the United States Patent and Trademark Office*